United States Patent [19]

McCaig

[11] Patent Number: 4,537,460

[45] Date of Patent: Aug. 27, 1985

[54] QUICK RELEASE CLAMP FOR BATTERY CABLE CONNECTOR

[75] Inventor: John R. McCaig, Wilmington, Mass.

[73] Assignee: McNold Corp., Wilmington, Mass.

[21] Appl. No.: 604,851

[22] Filed: Apr. 27, 1984

[51] Int. Cl.³ ..... H01R 11/26

[52] U.S. Cl. ..... 339/235; 339/239

[58] Field of Search ..... 269/236; 339/229, 235, 339/237-239, 263 B, 266 R, 274

[56] References Cited

U.S. PATENT DOCUMENTS

| | | | |
|---|---|---|---|
| 2,878,460 | 3/1959 | Coleman | 339/239 |
| 3,132,460 | 4/1967 | Kaufman | 269/236 |
| 4,475,726 | 10/1984 | Smith | 269/236 |

*Primary Examiner*—Joseph H. McGlynn
*Assistant Examiner*—Paula A. Austin
*Attorney, Agent, or Firm*—Thompson, Birch, Gauthier & Samuels

[57] ABSTRACT

This invention relates to a quick release clamp for applying the laterally constrictable ears of a cable connector to the terminal of an electric storage battery. The clamp includes a bolt having a threaded shank terminating at one end in an enlarged head. The shank is dimensioned to extend through aligned holes in the connector ears, with the bolt head being located on the outermost side of one of the ears. A nut is threaded onto the bolt shank on the outermost side of the other of the connector ears. A cam lever is rotatably connected to the bolt, and is adjustable between a closed position cooperating with the bolt and nut to laterally urge the connector ears together to grip the battery terminal therebetween, and an open position permitting the connector ears to move away from each other to an extent sufficient to permit the cable connector to be removed from the terminal.

7 Claims, 2 Drawing Figures

QUICK RELEASE CLAMP FOR BATTERY CABLE CONNECTOR

BACKGROUND OF THE INVENTION

1. Field of the Invention

This invention relates generally to cable connectors for electrical storage batteries, and more particularly to clamps used with such connectors.

2. Description of the Prior Art

The connector clamps of the prior art, as typified for example by those shown in U.S. Pat. Nos. 3,694,798 (Julian) and 3,936,134 (Piscionere), rely on the tightening of a nut on the threaded shank of a bolt to ensure lateral contact between the terminal of an electric storage battery and the laterally constrictable ears of the cable connector. However, several difficulties are associated with such arrangements. First, hand tools are required to disconnect the clamp, and such tools are not always readily available under emergency conditions, for example when the battery fails and requires replacement. Secondly, the terminal, connector and associated clamp elements are prone to chemical corrosion. Nuts and bolt heads are gradually eaten away, with the result that when wrenches are applied thereto, surfaces break off, making it difficult to loosen the bolts. These difficulties often translates into impossibility, at which point the bolts must be cut before clamp can be loosened and the connector removed from the terminal.

SUMMARY OF THE INVENTION

The object of the present invention is to provide a connector clamp which may be released quickly, without having to employ wrenches or other like hand tools, and without regard to corrosive damage, if any, to the connector and/or clamp components.

A companion object of the present invention is the provision of a clamp which effectively ensures contact between the laterally constrictable ears of the cable connector and the battery terminal, again without having to resort to the use of hand tools.

These and other objects and advantages are achieved with a preferred embodiment of the invention to be described hereinafter in more detail with reference to the accompanying drawings, wherein:

DETAILED DESCRIPTION OF PREFERRED EMBODIMENT

Figure 1:
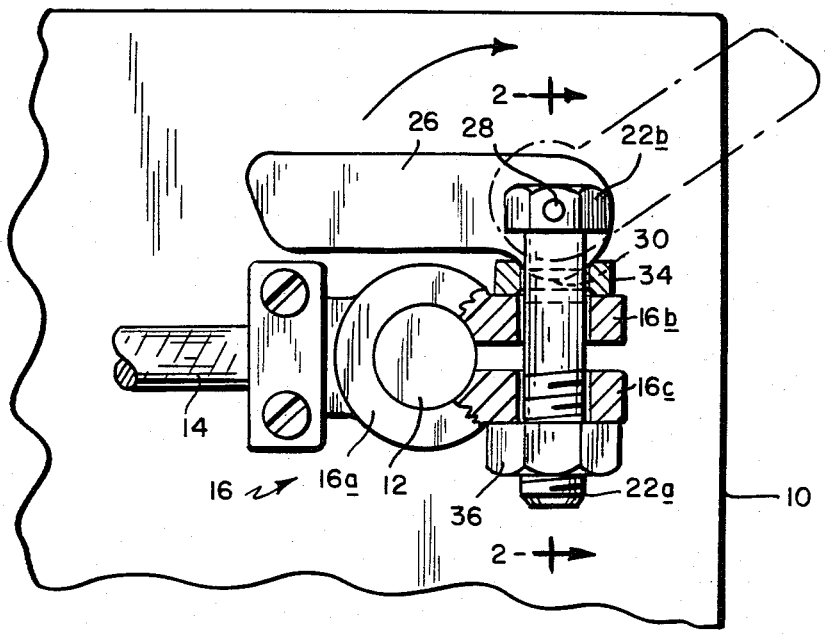
FIG. 1 is a top plan view, with portions broken away, of a cable connector together with quick release clamp in accordance with the present invention.

Referring now to the drawings, one portion of conventional electric storage battery 10 is shown with a terminal 12 protruding vertically therefrom. A cable 14 is connected to the terminal by means of a cable connector 16 which includes a somewhat semicylindrical base portion 16*a* with integrally formed ears 16*b*, 16*c* extending in a generally parallel relationship therefrom. The ears 16*b*, 16*c* are spaced one from the other at 18 and are provided with mutually aligned holes 20. The ears 16*b*, 16*c* are laterally constrictable around and against the terminal 12 to electrically connect the cable 14 to the battery.

This lateral constriction is achieved by the clamp of the present invention, which includes a bolt 22 having a threaded shank 22*a* terminating at one end in an enlarged hexagonal head 22*b*. The shank 22*a* is dimensioned to extend through the aligned holes 20 in the ears 16*c*, 16*c*, with the head 22*b* being located on the outermost side of the ear 16*b*. The bolt 22 has a slit 24 extending axially through the head 22*b* into the shank 22*a*.

A cam lever 26 is received in the slit 24 and is rotatably connected to the bolt 22 by means of a pin 28 extending across the slit in a direction transverse to the longitudinal bolt axis. The cam lever has a cam surface 30 lying on a reference circle (not shown) whose center 32 is offset by a distance "d" with respect to the axis of the pin 28.

A pressure washer 34 is axially received on the bolt shank 22*a* at a location between the bolt head 22*b* and the outermost side of ear 16*b*. At least one and preferably both sides of washer 24 are countersunk. Either countersunk side of the washer can coact in engagement with the cam surface 30 of lever 26.

The cam lever 26 is rotatably adjustable about the axis of pin 28 between a "closed" position illustrated by the solid lines in the drawings, and an "open" position indicated by the dot-dash lines in FIG. 1. A nut 36 is threaded onto the shank 22*a* on the outermost side of ear 16*c*. When initially installing the clamp, the nut is merely hand-tightened to bring the pressure washer 34 lightly against the outermost surface of ear 16*b* and the nut lightly against the outermost surface of ear 16, with the cam lever 26 being adjusted to its open position. At this adjustment, the ears 16*b*, 16*c* are not being urged together to narrow the gap 18, thus allowing the connector to be easily placed onto or removed from the terminal 12.

Figure 2:
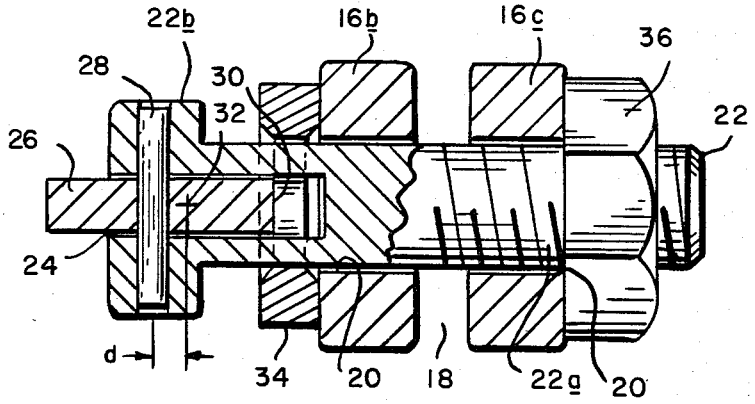
FIG. 2 is a sectional view on an enlarged scale taken on line 2—2 of FIG. 1.

Preferably, the bolt 22, lever 26, pin 28, washer 34 and nut 36 are stainless steel in order to minimize corrosion. When the cam lever is adjusted to the closed position, the cam surface 30 engages the adjacent countersunk side of the pressure washer 34, thereby pulling the bolt 22 through the pressure washer to the left as viewed in FIG. 2. This also pulls the nut 36 in the same direction, with the result that the pressure washer 34 and nut 36 act on their respectively adjacent ear surfaces to laterally constrict the ears 16*b*, 16*c* against and around the battery terminal. The net result is a secure clamping of the connector to the battery terminal, without having to resort to the use of hand tools. Should it become necessary to remove the connector from the terminal, one need only rotate the cam lever 26 to its open position. This relieves the constraining force on the ears 16*b*, 16*c* to an extent sufficient to allow the connector to be pulled off of the terminal. This can be accomplished in a rapid quick-disconnect manner without the use of hand tools, and despite any corrosion that might have taken place.

I claim:

1. A quick release clamp for applying the laterally constrictable ears of a cable connector to the terminal of an electric storage battery, comprising: a bolt having a threaded shank terminating at one end in an enlarged head and having a slit extending axially through said head into said shank, said shank being dimensioned to extend through aligned holes in said ears with said enlarged head being located on the outermost side of one of said ears; a nut threaded onto said shank on the outermost side of the other of said ears; and a cam lever received in said slit, said lever being rotatably connected to said bolt by means of a pin extending transversally across said slit, said lever being adjustable between a closed position cooperating with said bolt and nut to laterally urge said ears together to grip said terminal therebetween, and an open position permitting said ears to move away from each other to an extent sufficient to permit said cable connector to be removed from said terminal.

2. The quick release clamp of claim 1 wherein said lever is rotatably adjustable about an axis extending transversally with respect to the longitudinal axis of said bolt.

3. The quick release clamp of claim 1 further comprising a pressure washer axially received on said shank at a location between said head and the outermost side of the said one of said ears, said cam lever being engageable with said pressure washer.

4. The quick release clamp of claim 3 wherein said bolt, nut, pressure washer and cam lever are fabricated of stainless steel.

5. The quick release of claim 3 wherein at least one side of said pressure washer is countersunk to receive said cam lever.

6. A quick release clamp for applying the laterally constrictable ears of a cable connector to the terminal of an electric storage battery, comprising:

a bolt having a threaded shank terminating at one end in an enlarged head, said bolt having a slit extending axially through said head into said shank, said shank being dimensioned to extend through aligned holes in said ears with said head being located on the outermost side of one of said ears;

a cam lever received in said slit and rotatably connected to said bolt by means of a pin extending across said slit in a direction transverse to the longitudinal bolt axis;

a pressure washer axially received on said shank at a location between said head and the outermost side of the said one of said ears; and a nut threaded onto said shank on the outermost side of the other of said ears, said cam lever being rotatably adjustable between a closed position cooperating with said bolt, nut and pressure washer to laterally urge said ears together to grip said terminal therebetween, and an open position permitting said ears to move away from each other to an extent sufficient to permit said cable connector to be removed from said terminal.

7. A quick release clamp for applying the laterally constrictable ears of a cable connector to the terminal of an electric storage battery, comprising: a bolt having a threaded shank terminating at one end in an enlarged head, said shank being dimensioned to extend through aligned holes in said ears with said enlarged head being located on the outermost side of one of said ears; a nut threaded onto said shank on the outermost side of the other of said ears; a pressure washer axially received on said shank at a location between said head and the outermost side of the said one of said ears, at least one side of said pressure washer being countersunk, and a cam lever rotatably connected to said bolt, said lever being adjustable between a closed position acting against the countersunk side of said pressure washer and cooperating with said bolt and nut to laterally urge said ears together to grip said terminal therebetween, and an open position permitting said ears to move away from each other to an extent sufficient to permit said cable connector to be removed from said terminal.

* * * * *